United States Patent [19]

Leedham

[11] 4,049,048

[45] Sept. 20, 1977

[54] FINNED TUBE BUNDLE HEAT EXCHANGER

[75] Inventor: Harry W. T. Leedham, Kitchener, Canada

[73] Assignee: Borg-Warner Corporation, Chicago, Ill.

[21] Appl. No.: 642,506

[22] Filed: Dec. 19, 1975

[51] Int. Cl.[2] ..... F28F 9/22

[52] U.S. Cl. ..... 165/159; 165/161

[58] Field of Search ..... 165/158–161, 165/181

[56] References Cited

U.S. PATENT DOCUMENTS

| | | | |
|---|---|---|---|
| 2,540,339 | 2/1951 | Kritzer | 165/181 |
| 2,612,350 | 9/1952 | Stadler | 165/159 X |
| 3,135,320 | 6/1964 | Forgo | 165/181 X |
| 3,397,741 | 8/1968 | Gunter | 165/152 |

FOREIGN PATENT DOCUMENTS

| | | | |
|---|---|---|---|
| 920,079 | 11/1954 | Germany | 165/158 |

*Primary Examiner*—Carroll B. Dority, Jr.
*Assistant Examiner*—Theophil W. Streule, Jr.
*Attorney, Agent, or Firm*—James A. Geppert

[57] ABSTRACT

A finned tube bundle heat exchanger utilized for heat transfer between a pair of countercurrent circulating liquids, such as for an oil cooler, wherein a bundle of tubes for the flow of one liquid therethrough pass through spaced openings in a plurality of fins or plates which are in heat transfer contact therewith. The fins are provided with a plurality of slits extending over a substantial portion of the fin surface to provide fluid flow directing openings and/or act to interrupt the fluid boundary layer on the surface of each fin and enhance the heat transfer characteristics of the finned tube bundle.

20 Claims, 14 Drawing Figures

10
11
12
13
13'
14
14'
15
16
17
17'
18
19
21
22
23
24
25
27
28
38

19
25
26
27
27'
28
37
38

4
5
28
29
32

10a
11a
12a
13a
14a
15a
19a
21a
22a
23a
24a
25a
27a
28a
29a
31a
37a
38a
39
41
42
43

FINNED TUBE BUNDLE HEAT EXCHANGER

BACKGROUND AND SUMMARY OF THE INVENTION

The present invention relates to a heat exchanger utilizing a tube bundle therein, and more particularly to a finned tube bundle oil cooler of the countercurrent type.

Tube bundle heat exchangers of the countercurrent type having an outer casing or shell receiving a tube bundle comprising a plurality of tubes secured between oppositely disposed headers adapted to be positioned in the ends of the casing are known in the heat exchange art. One fluid passes through the tubes from one end of the casing to the other, and a second fluid is introduced into the casing to flow in the opposite direction and in heat exchange relationship with the exterior surfaces of the tubes. Without more, this system provides a relatively inefficient system of heat exchange between the two fluids. To increase the heat exchange properties, a series of baffles are usually provided in the casing to alter the flow pattern of the fluid surrounding the tubes. The baffles generally take the form of discs closely conforming to the casing interior having openings formed therein through which the tubes pass and having portions removed from their peripheries to allow the passage of fluid from one side of the baffle to the other.

These baffles are generally termed segmental and are spaced apart from one another by tubular spacers which are positioned on longitudinally running "stay rods" during assembly. The baffles are arranged so that the cutaway portions alternately face opposite sides causing the fluid to alternate from one side of the casing to the other in a sinuous fashion to pass transversely across and around the tubes as it makes its way from one end of the casing to the other. Generally to minimize leakage, the baffles are brazed or soldered to the tubes of the bundle.

To further enhance the heat transfer characteristics, the tubes may also be supplied with fins to further increase the heat exchange surface area. These fins may be a plurality of radial flanges which are individually secured onto the exterior surface of each tube, or they may take the form of generally circular plates having openings receiving the tubes and cut-away portions on opposite sides to allow for the sinuous passage of the fluid around the plates and tubes and through the casing. In this arrangement, the stack of plates are aligned on the tubes with the cut-away portions aligned with the cut-away portions of the baffles; the baffles being spaced along the stack of plates with their cut-away portions alternating on opposite sides. Thus, fluid may pass parallel to the plates between a pair of adjacent baffles and transversely across the tubes and around the baffle plate through the cut-away portion to flow through the next set of plates in the opposite direction. The cut-away portions of the plates will act to distribute fluid longitudinally along the stack of plates. The stack of plates or fins acts to maximize the heat transfer surface between the two fluids.

The present invention is an improvement on the above described finned tube bundle with the elimination of the necessity for the series of baffle plates. To accomplish this, a plurality of circular metal plates are provided with openings to receive therethrough the tubes in the tube bundle; the circular plates having peripheries substantially conforming and sealingly received within the casing for the heat exchanger. Each plate is further provided with a plurality of slits therein to allow for generally axial flow of a liquid around the tubes through the casing in a direction countercurrent to the flow of liquid through the tubes. With the plates closely stacked on the tubes and conformably received in the casing, the flow of fluid is substantially axial along and around the tubes, but it is broken up into smaller streams and effectively turbulized by the plurality of slits in each plate.

Further, the slits in the fins serve as extended heat transfer surfaces for the fluid that is circulating around the tubes in the tube bundle, the slits in the fins increasing the heat transfer capacity through the interrupting of the fluid boundary layer on the surface of the fins. In addition to the heat transfer aspect of the fins, the slits formed in the fins act as baffles by directing the flow of fluid. In formation, the slitting of the fins by stamping forms a plurality of small louvres which, for each fin, are generally all oriented in one direction. When stacked together on the tube bundle, all of the fins may be positioned with the louvres oriented in one direction or alternate fins may be rotated to orient the louvres in opposite directions on adjacent fins.

Also, this fin stack may be utilized with a series of imperforate fins provided at intervals to act as baffles. Such baffles have openings for the tubes, but are otherwise imperforate and are cut-away at a portion of their peripheries to provide segmental plates oriented with the cut-away portions at alternate sides to provide a cross-flow action of the fluid relative to the tubes in a sinuous fashion.

An object of the present invention is the provision of a finned tube bundle heat exchanger having a plurality of slits formed in each fin between the tubes to improve the heat transfer characteristics of the heat exchanger.

Another object of the present invention is the provision of a finned tube bundle heat exchanger wherein the slits formed in the fins act as baffles for directing the flow of fluid generally axially along the tube bundle in the casing.

Further objects are to provide a construction of maximum simplicity, efficiency, economy and ease of assembly and operation, and such further objects, advantages and capabilities as will later more fully appear and are inherently possessed thereby.

DESCRIPTION OF PREFERRED EMBODIMENTS

Figure 1:
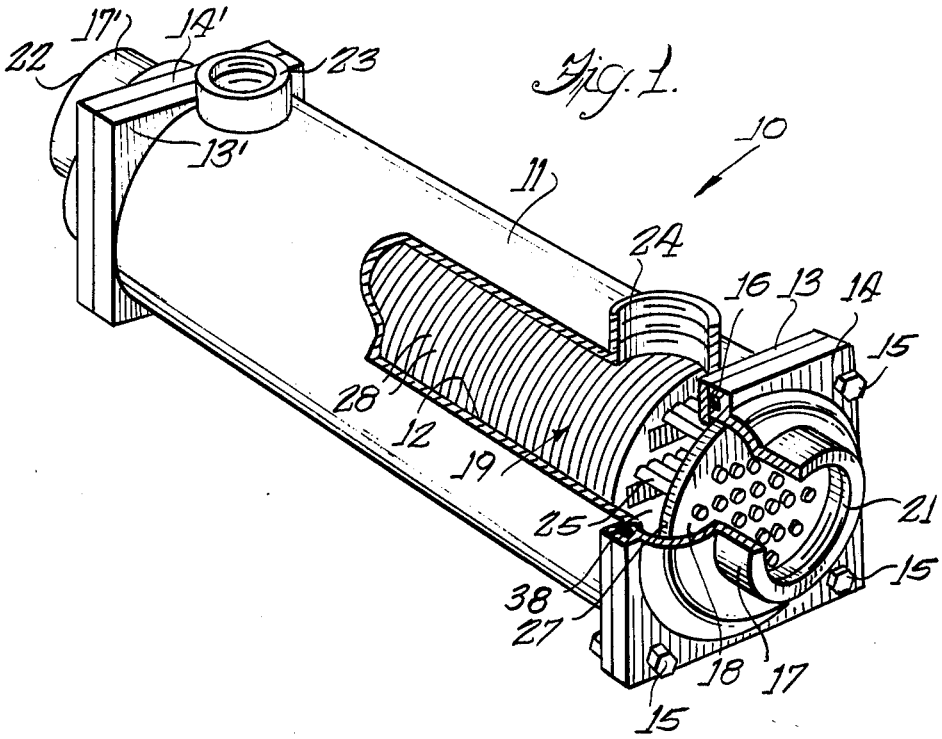
FIG. 1 is a perspective view of heat exchanger, partially broken away, incorporating the finned tube bundle of the present invention.
Figure 2:
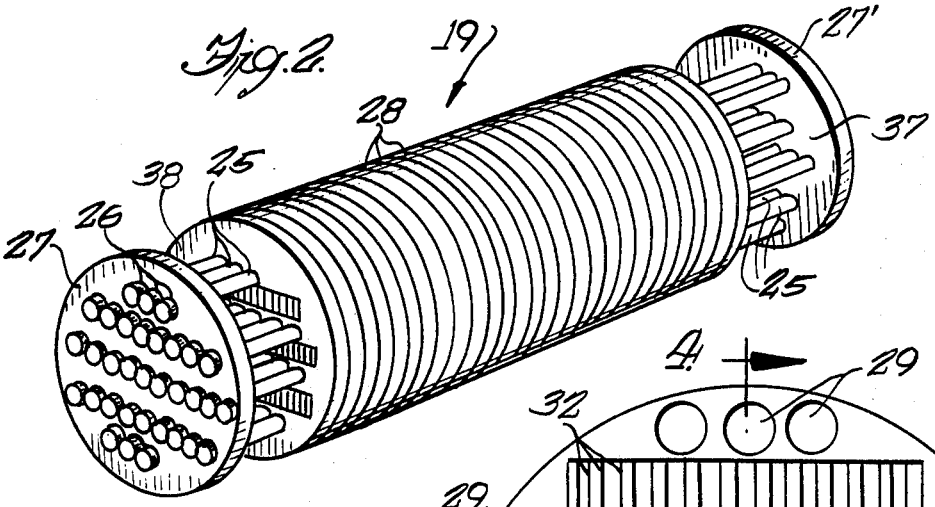
FIG. 2 is a perspective view of the finned tube bundle and header plates removed from the casing.

Referring more particularly to the disclosure in the drawings wherein are shown illustrative embodiments of the present invention, FIG. 1 discloses a two-fluid heat exchanger 10, such as would be utilized as an oil cooler for the engine oil or transmission oil of an automobile, having a generally cylindrical hollow casing or shell 11 with a cylindrical interior surface 12 and terminating in a pair of radial end flanges 13, 13'. A pair of end plates or bonnets 14, 14' are secured to the end flanges by suitable securing means, such as bolts 15, with sealing gaskets 16 interposed between abutting surfaces of the flanges and end plates to suitably seal the heat exchanger.

Each end plate 14, 14' is provided with a fluid conduit 17, 17' generally centrally located therein and opening into a chamber 18 formed in the end plate to distribute fluid through a tube bundle 19. The conduit in the plate 14 acts as a fluid inlet 21 while the conduit in the opposite plate 14' acts as a fluid outlet 22. The casing 11 is also provided with a generally radially extending fluid inlet 23 adjacent the flange 13' and end plate 14' and a fluid outlet 24 adjacent the flange 13 and end plate 14 for a second fluid entering the casing 11 to pass around and through the tube bundle 19.

The tube bundle 19 consists of a plurality of longitudinally extending laterally spaced tubes 25 which have their ends expanded or otherwise suitably secured in openings 26 formed in a pair of header plates 27, 27', which are conformably received in the cylindrical interior surface 12 of the shell 11 at the ends thereof. Mounted on the tubes 25 are a large number of fins 28 in the form of metal discs having a high heat conductivity and provided with a series of openings 29 arranged in rows to receive the tubes therethrough; the openings 29 being defined by longitudinally extending annular flanges 31 extruded in the punching operation for the openings. The annular flanges 31 are preferably brazed or soldered to the tubes 25 or mounted thereon by an interference fit. This interference fit may be obtained by expanding the tubes, swaging down the annular flanges 31, or by using long taper annular flanges and compressing the fin stack.

Figure 5:
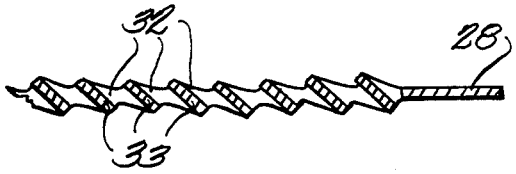
FIG. 5 is an enlarged partial horizontal cross sectional view taken on the line 5—5 of FIG. 3.
Figure 6:
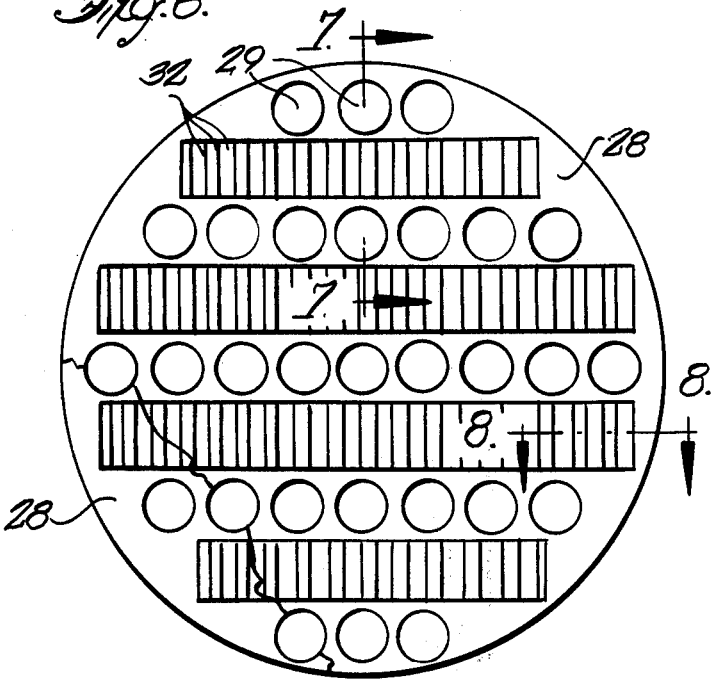
FIG. 6 is a front elevational view of at least a pair of fins as assembled on the tube bundle.
Figure 7:
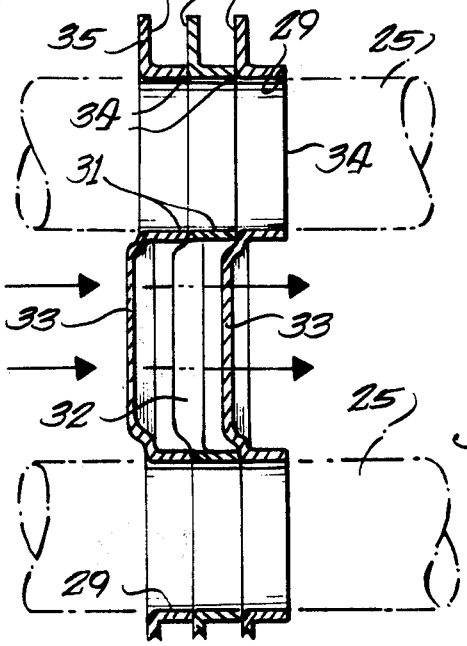
FIG. 7 is an enlarged partial vertical cross sectional view taken on the line 7—7 of FIG. 6.
Figure 8:
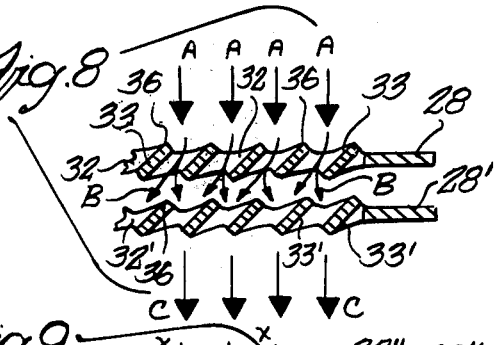
FIG. 8 is an enlarged partial horizontal cross sectional view taken on the line 8—8 of FIG. 6.

Formed between the rows of openings 29 are a plurality of slits 32 which are transversely oriented to the rows of openings and define a series of closely adjacent louvres 33 in the fin. The slits and louvres are all stamped in the fin in rows paralleling the rows of openings and are oriented in the same angular direction in the disc as seen in FIGS. 5 and 8. These discs have a circular periphery to be conformably received in the shell with little or no leakage between the fins and the surface 12. Also, as seen in FIG. 7, each annular flange 31 has an end surface 34 which is adapted to abut the facing surface 25 of the next adjacent fin 28, when the fins are stacked on the tubes, to space adjacent fins apart a predetermined amount to allow fluid movement between the fins and provide sufficient spacing to accommodate the angularly oriented louvres.

As seen in FIG. 8, the louvres 33 of adjacent fins are so spaced that fluid flow shown by arrows A passes through the slits 32 between the louvres 33 of a first fin 28 whereupon the flow through each slit as shown by arrows B impinges upon a leading edge 36 of a louvre 33' in the next fin 28'; thus tending to break up the flow and reform the fluid streams through the next set of slits 32' and to exit therefrom as shown by arrows C. This splitting and reforming of the fluid streams will occur at each fin thus providing a high degree of turbulance in the shell.

Figure 9:
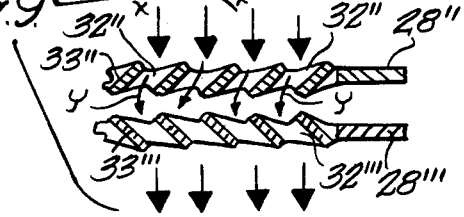
FIG. 9 is a partial horizontal cross sectional view similar to FIG. 8 but showing an alternate orientation of adjacent fins.

The simplest method of assembly of the finned tube bundle would be to orient all of the fins in the same direction with the louvres all angularly oriented in one direction as seen in FIG. 8; however, as the fins are symmetrical about a horizontal center line, an alternative assembly would be to rotate every other fin through 180° so that the louvres of adjacent fins are disposed in opposite directions as shown in FIG. 9. In this embodiment, the flow as shown by the arrows X passes through the slits 32'' of the first fin 28'' angularly oriented by the louvres 33'' and then, the louvres 33''' of the second fin 28''' act to alter the fluid path in the opposite direction as shown by the arrows Y. Also, the invention comprehends a random arrangement of the fins on the tubes without regard to the angular orientation of the louvres.

In operation, cooling fluid, such as water, enters the fluid inlet 21 and the header chamber 18 to be distributed into the tubes 25 in the bundle 19 and flow longitudinally therethrough. After the heat exchange or cooling is effected, the heated water exits through the fluid outlet 22. Oil or other hot fluid to be cooled enters the shell 11 through the second fluid inlet 23 adjacent the fluid outlet 22 to pass through the shell countercurrent to the flow of cooling fluid. A space 37 is provided between the header plate 27' and the first fin 28 of the stack generally aligned with the second fluid inlet 23 to allow distribution of the oil over all the tubes across the end of the shell. The oil then flows generally longitudinally through the slits 32 in the fins 28 passing through the stack of fins to a second space 38 between the last fin and the second header plate 27 generally aligned with the second fluid outlet 24. The now cooled oil exits through the fluid outlet 24 to be returned to service in an automobile engine or other environment.

The spacing 37 and 38 between the fins and the header plates may be effected by soldering or brazing the fins to the tubes, or spacing sleeves may be positioned on several of the tubes between the header plate and the first fin. The fins serve as extended heat transfer surfaces for the fluid that is circulating around the tubes in the tube bundle, and the slits 32 in the fins serve to increase the heat transfer capacity by interrupting the fluid layer boundary on the surface of each fin. In addition to the heat transfer aspect, the slits and louvres serve as baffles as well because they direct the flow of the fluid through the casing in a generally longitudinal manner. All flow in this heat exchanger 10 of the fluid to be cooled is only through the slits with the louvres formed by the slits directing the flow in a diagonal sense relative to the tubes as previously described.

Figures 10, 11, 12:
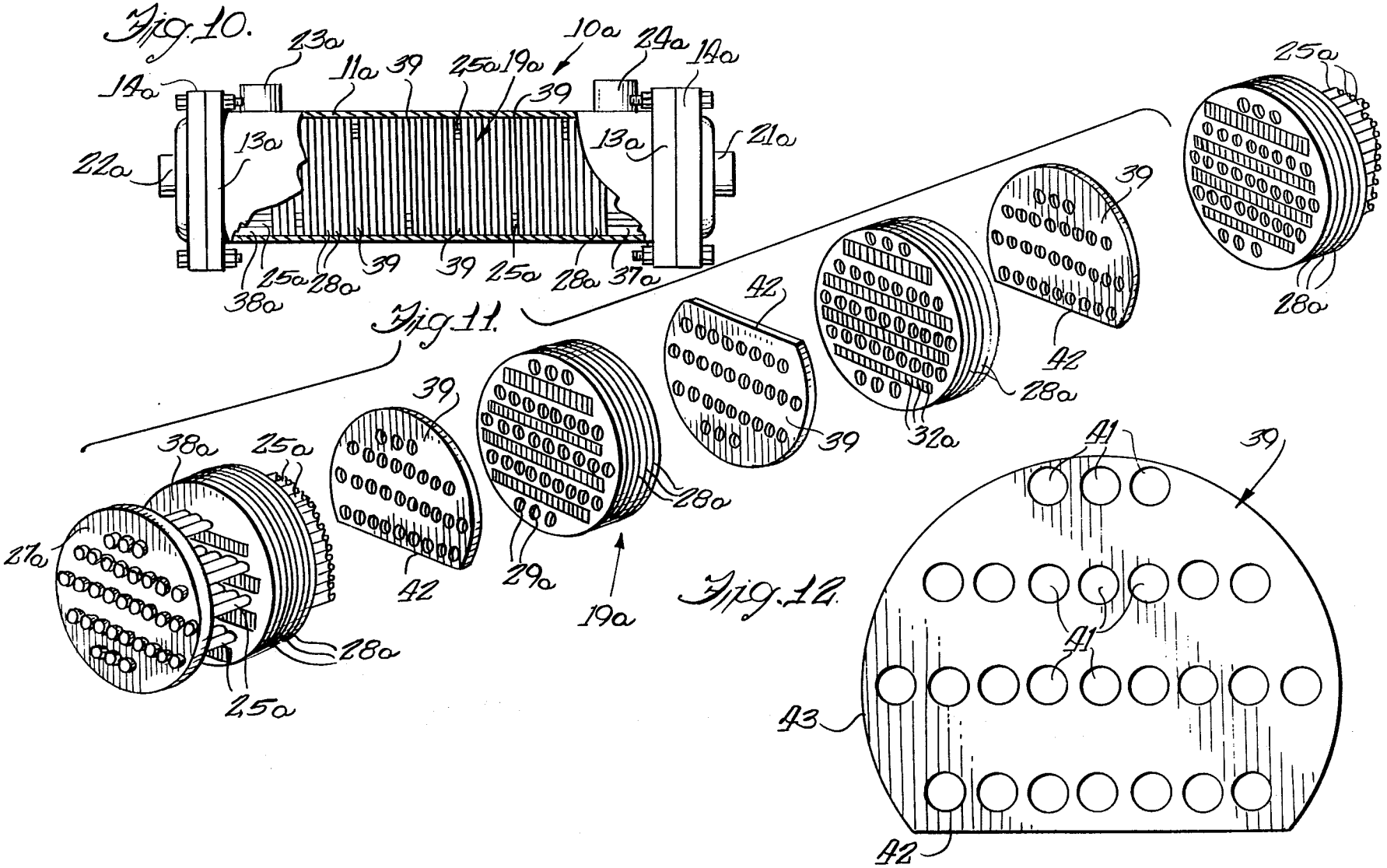
FIG. 10 is a side elevational view, partially broken away, of an alternate embodiment of heat exchanger.
FIG. 11 is an exploded perspective view of the finned tube bundle of FIG. 10.
FIG. 12 is a front elevational view of a baffle plate utilized in the finned tube bundle of FIGS. 10 and 11.

FIGS. 10 through 12 disclose an alternate embodiment of heat exchanger **10*a*** wherein like parts will have the same reference numeral with a script *a*. The heat exchanger includes a casing 11*a* with end flanges 13*a*, end plates 14*a*, a tube bundle 19*a*, a first fluid inlet 21*a*, a first fluid outlet 22*a*, a second fluid inlet 23*a* and a second fluid outlet 24*a*. The tube bundle 19*a* includes a plurality of longitudinally extending tubes 25*a* between a pair of header plates 27*a* and a plurality of fins 28*a* having openings 29*a* for the tubes and slits 32*a* for flow through the fins and around the tubes.

The fins 28*a* are spaced from each header plate 27*a* to provide fluid distribution spaces 37*a*, 38*a* for the fluid entering the inlet 23*a* and exiting via the outlet 24*a* to allow circulation around the tubes 25*a*. Interposed at spaced intervals in the stack of fins are several baffle plates 39 which have a generally circular periphery 43 conformably received within the shell 11*a* and a plurality of openings 41 to sealingly receive the tubes 25*a* in the bundle 19*a*. Other than the openings 41, the baffle plates are imperforate and have a cut-away portion defined by an edge 42 extending across the plate in chordal fashion.

As shown in FIGS. 10 and 11, the baffle plates 39 are arranged in the fin stack with the cut-away edge 42 of successive plates alternating in position through a rotation of 180°. These plates act to direct the fluid flow in the casing around the tubes in a generally sinusoidal fashion, as fluid can only pass through the cut-away portion of each baffle plate. Thus, fluid not only passes through the slits in each fin 28*a*, but also through the cut-away portions of the baffle plates promoting a cross flow of the fluid relative to the tubes. Through these fluid flow paths and the louvres formed in the fins, the heat transfer operation from the fluid circulating around the tubes to the flowing through the tubes is improved and enhanced.

Figure 13:
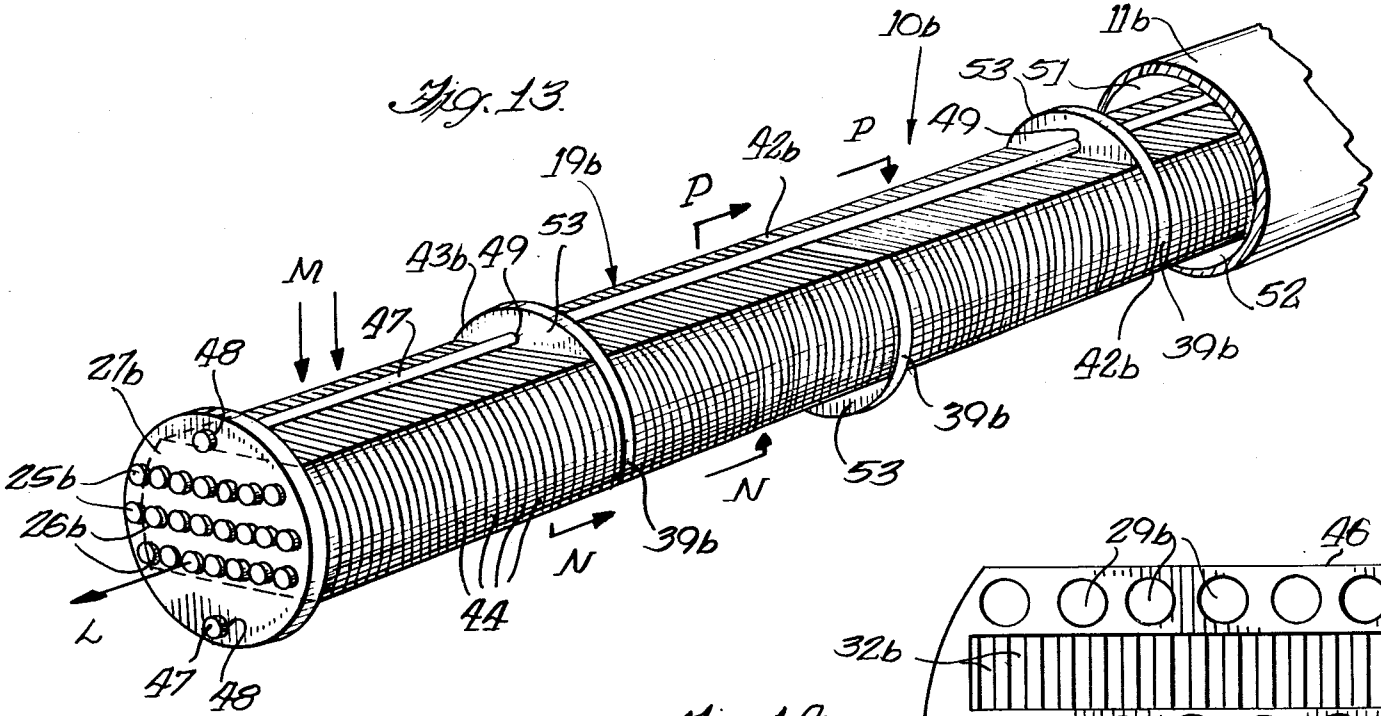
FIG. 13 is a perspective view, partially broken away, of a third embodiment of heat exchanger.
Figure 14:
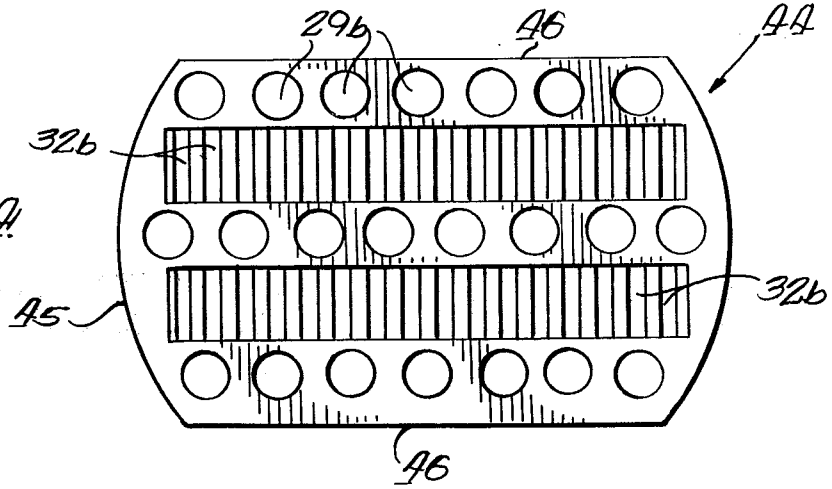
FIG. 14 is a front elevational view of a fin utilized in the heat exchanger of FIG. 13.

FIGS. 13 and 14 disclose a third embodiment of heat exchanger wherein like parts will have the same reference numeral with a script *b*. The heat exchanger 10*b* includes a casing 11*b* and a tube bundle 19*b*; the casing having end plates, first and second fluid inlets and first and second fluid outlets (not shown). The tube bundle 19*b* includes a plurality of longitudinally extending tubes 25*b* between a pair of header plates 27*b* and a plurality of fins 44 having openings 29*b* for the tubes and slits 32*b* for flow through the fins and around the tubes. Also, each opening 29*b* is defined by an extruded annular flange (not shown) acting to space the fins apart in the bundle 19*b*.

Figure 3:
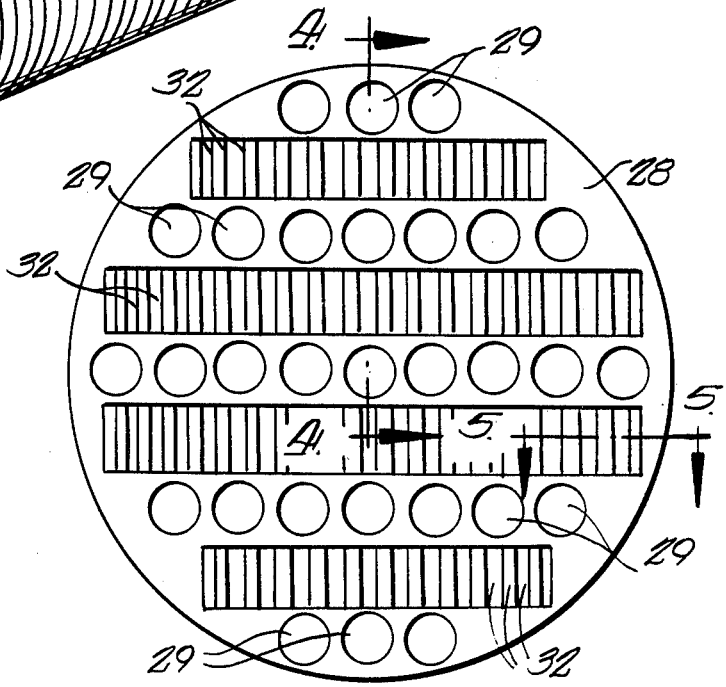
FIG. 3 is a front elevational view of a single fin or disc from the tube bundle.
Figure 4:
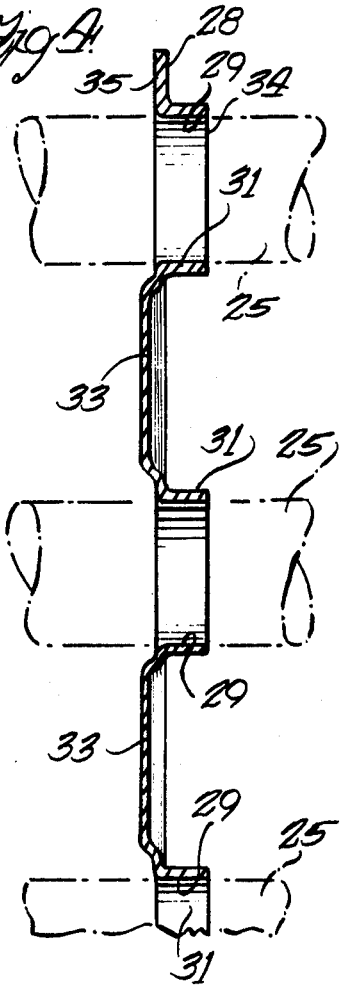
FIG. 4 is an enlarged partial vertical cross sectional view taken on line 4—4 of FIG. 3.

Each fin 44 as seen in FIG. 14, is similar to the fin 28 or 28*a* in having a generally circular periphery 45, but the periphery is cut-away on diametrically opposite sides thereof as defined by the parallel edges 46, 46 extending across the plate in chordal fashion. Comparing this fin with the fin 28 in FIG. 3, it can be seen that the top and bottom rows of openings 29 and slits 32 have been cut-away from the fin 44. Also, there is no spacing between the fins 44 and either header 27*b*. One or more tubes 47 extend longitudinally along the finned tube bundle 19*b* and are secured in openings 48 in the headers 27*b* to provide additional rigidity for the tube bundle. The tubes 25*b* are secured in openings 26*b* in the headers 27*b* in the same manner as the previous embodiments.

Interposed at spaced intervals in the stack of fins 44 are several baffle plates 39*b* which have a generally circular periphery 43*b* and a plurality of openings to sealingly receive the tubes 25*b* in the bundle 19*b*. Instead of the top row of openings shown in FIG. 12 for the baffle plates 39*b*, each plate has one or more openings 49 to sealingly receive the tubes 47 to add rigidity to the bundle 19*b*. Each plate 39*b* has a cut-away portion defined by the edge 42*b* comparable to the cut-away portion of a fin 44, and the baffle plates are otherwise imperforate.

As shown in FIG. 13, the baffle plates 39*b* are arranged in the fin stack with the cut-away edge 42*b* of successive plates alternating through 180° to be in alignment with either of the edges 46 of the fins 44. The cut-away portions of the fins provide, with the interior cylindrical wall of the casing 11*b*, a pair of longitudinally extending segmental chambers 51, 52 on diametrically opposite sides of the heat exchanger 10*b*; the chambers only being interrupted by the portions 53 of alternate baffle plates 39*b* having the openings 49 therein to receive the tubes 47.

Fluid passing through the tubes 25*b* and 47 enters the casing 11*b* through the first fluid inlet (not shown), passes through the tubes and headers 27*b* and exits through the first fluid outlet (not shown) denoted by arrows L. The second fluid enters the casing through the second fluid inlet (not shown) into a segmental chamber 51, as shown by arrows M, and passes downward between the fins 44 and longitudinally through the slits 32*b* in the fins in the area between the header 27*b* and the first baffle plate 39*b* to the chamber 52. There, as shown by the arrows N, the fluid moves longitudinally in the chamber 52 past the cut-away portion of the first baffle plate 39*b* and then moves upward between and through the fins positioned between the first two baffle plates to enter the chamber 51 beyond the portion 53 of the first baffle plate. Then, as shown by the arrows P, the fluid moves longitudinally past the cut-away portion of the second baffle plate and then alternately around the remaining baffle plates to provide a generally sinusoidal flow pattern to provide enhanced heat transfer between the two fluids through the tubes 25*b* and the fins 44.

I claim:

1. A heat exchanger comprising an outer elongated shell having a central passage extending therethrough, a pair of header plates having first fluid conduit means associated therewith, a plurality of tubes within said shell and extending longitudinally thereof with their ends sealed within apertures in said header plates, said tubes being in communication with said first conduit means, a plurality of fins stacked on said tubes between the header plates and generally conformably received within said shell, each fin having a plurality of openings defined by annular flanges extending from one surface of each fin receiving the tubes therethrough and a plurality of slits therein providing for liquid flow therethrough and generally axially along the tubes, said fins being stacked with the flanges of one fin abutting the opposite surface of the next adjacent fin to provide for spacing between adjacent fins, and second fluid conduit means associated with said shell for communication thereinto for fluid contact with the fins and the outer surfaces of said tubes.

2. A heat exchanger as set forth in claim 1, wherein each fin is a circular disc formed of a material having a high heat conductivity and adapted to be conformably received in the central passage in the shell so that all liquid flow around the tubes will be through the slits in the fins.

3. A heat exchanger as set forth in claim 1, in which said openings in the fins are arranged in parallel rows and said slits are arranged in rows parallel to and between said rows of openings, said slits defining angularly disposed louvres therebetween.

4. A heat exchanger as set forth in claim 3, in which said louvres extend from both surfaces of each fin into the spacing between adjacent fins.

5. A heat exchanger as set forth in claim 1, wherein said first fluid conduit means includes a pair of end plates sealingly engaging the opposite ends of said shell, each end plate having a distribution chamber communicating with the ends of the tubes in the adjacent header plate, and a fluid conduit formed in the end plate and communicating with its respective chamber.

6. A heat exchanger as set forth in claim 1, wherein said second fluid conduit means includes a pair of radially extending fluid conduits integral with said shell adjacent the ends thereof, said conduits communicating with said shell at locations inside of said header plates.

7. A heat exchanger as set forth in claim 6, in which said fins are spaced from each header plate to provide a chamber generally aligned with each radial fluid conduit.

8. A heat exchanger as set forth in claim 4 in which all of the louvres on each fin are oriented in the same angular direction, and each fin on the tube bundle is positioned so that all of the louvres on all of the fins are disposed in the same direction.

9. A heat exchanger as set forth in claim 4, in which all of the louvres on each fin are oriented in the same angular direction, and alternate fins on the tube bundle are rotated through 180° so that the louvres on one fin are angularly disposed in a direction opposite to the louvres in an adjacent fin.

10. A heat exchanger as set forth in claim 4, including baffle plates interposed at spaced intervals in the stack of fins, each baffle plate being imperforate except for openings receiving said tubes and having a cut-away portion, the cut-away portions of the baffle plates being alternately arranged to provide a sinuous flow of fluid around said tubes.

11. A heat exchanger as set forth in claim 1, wherein each fin is a disc having diametrically opposite cut-away portions, said openings in the fins are arranged in rows and said slits are arranged in rows between the rows of openings, and baffle plates interposed at spaced intervals in the stack of fins, each baffle plate being imperforate except for openings receiving said tubes and having a cut-away portion, the cut-away portions of the baffle plates being alternately arranged in axial alignment with the cut-away portions of the fins to provide a sinuous flow of fluid around said tubes.

12. A heat exchanger as set forth in claim 11, including one or more rigidifying tubes extending between said header plates in the spaces resulting from the cut-away portions of the fins and passing through openings in the portions of the baffle plates extending into said last-mentioned spaces.

13. A heat exchanger as set forth in claim 12, in which said fins are closely stacked adjacent to said header plates.

14. A heat exchanger as set forth in claim 2, in which said openings in the fins are arranged in parallel rows and said slits are arranged in rows parallel to and between said rows of openings, said slits defining angularly disposed louvres therebetween.

15. A heat exchanger as set forth in claim 14, in which said louvres on each fin are oriented in the same direction.

16. A heat exchanger as set forth in claim 15, in which all of the fins are positioned on the tubes so that all of said louvres are angularly disposed in the same direction.

17. A heat exchanger as set forth in claim 15, in which alternate fins are rotated 180° so that the louvres of one fin are angularly disposed in the opposite direction to the louvres in an adjacent fin.

18. A heat exchanger as set forth in claim 14, in which said fins are spaced from each header plate and are closely stacked about the tubes intermediate the header plates.

19. A heat exchanger as set forth in claim 10, in which each fin is a circular disc adapted to be conformably received in the central passage in the shell so that all liquid flow around the tubes will be through the slits in the fins.

20. A heat exchanger as set forth in claim 19, in which said fins are spaced from each header plate to provide a chamber at each end of the stacked fins.

* * * * *